US012715669B2

(12) United States Patent
Boersma

(10) Patent No.: US 12,715,669 B2
(45) Date of Patent: Aug. 25, 2026

(54) CARTON FOR CONTAINERS

(71) Applicant: Graphic Packaging International, LLC, Atlanta, GA (US)

(72) Inventor: Harmen Boersma, Heerenveen (NL)

(73) Assignee: Graphic Packaging International, LLC, Atlanta, GA (US)

( * ) Notice: Subject to any disclaimer, the term of this patent is extended or adjusted under 35 U.S.C. 154(b) by 4 days.

(21) Appl. No.: 18/660,417

(22) Filed: May 10, 2024

(65) Prior Publication Data

US 2024/0375839 A1 Nov. 14, 2024

Related U.S. Application Data

(60) Provisional application No. 63/466,048, filed on May 12, 2023.

(51) Int. Cl.
*B65D 71/00* (2006.01)
*B65D 71/56* (2006.01)

(52) U.S. Cl.
CPC ..... *B65D 71/0014* (2013.01); *B65D 2313/00* (2013.01); *B65D 2571/00283* (2013.01); *B65D 2571/00388* (2013.01); *B65D 2571/00444* (2013.01); *B65D 2571/0066* (2013.01)

(58) Field of Classification Search
CPC ..... B65D 71/0014; B65D 2571/00728; B65D 2571/00141; B65D 2571/0066
USPC ..... 206/139, 427, 434
See application file for complete search history.

(56) References Cited

U.S. PATENT DOCUMENTS

| | | | |
|---|---|---|---|
| 2,225,822 | A | 12/1940 | Crook |
| 2,227,330 | A | 12/1940 | Turner |
| 2,331,312 | A | 10/1943 | Dorfman |
| 2,336,857 | A | 12/1943 | Gies |
| 2,460,108 | A | 1/1949 | Smith |
| 2,689,061 | A | 9/1954 | Gray |
| 2,721,001 | A | 10/1955 | Hasselhoff |
| 2,776,072 | A | 1/1957 | Forrer |
| 2,783,916 | A | 3/1957 | Hodapp |
| 3,029,977 | A | 4/1962 | Arneson |
| 3,053,411 | A | 9/1962 | Struble |
| 3,128,906 | A | 4/1964 | Forrer |
| 3,190,487 | A | 6/1965 | Wood |

(Continued)

FOREIGN PATENT DOCUMENTS

| | | |
|---|---|---|
| DE | 9004439 | 6/1990 |
| EP | 1319607 | 6/2003 |

(Continued)

OTHER PUBLICATIONS

International Search Report and Written Opinion for PCT/US2024/028734 dated Aug. 27, 2024.

*Primary Examiner* — Steven A. Reynolds
(74) *Attorney, Agent, or Firm* — Andrew N. Claerbout; FisherBroyles, LLP

(57) ABSTRACT

A carton for holding a plurality of containers includes a plurality of panels at least partially extending around an interior of the carton, the plurality of panels including a front panel, a back panel, at least one side panel, at least one top panel, and at least one bottom panel, and a divider extending through the interior of the carton to form a front interior space and a back interior space, the divider including a divider panel attached to the at least one side panel.

31 Claims, 6 Drawing Sheets

(56) References Cited

U.S. PATENT DOCUMENTS 3,191,800 A 6/1965 Kowal
3,194,478 A 7/1965 Weiss
3,229,849 A 1/1966 Spillson
3,236,414 A 2/1966 Slevin, Jr.
3,313,466 A 4/1967 Keith
3,343,742 A 9/1967 Siegler
3,351,230 A 11/1967 Schuster
3,432,073 A 3/1969 Forrer
3,554,401 A 1/1971 Wood
3,624,790 A 11/1971 Stout
3,661,297 A 5/1972 Wood
3,669,306 A 6/1972 Forrer
3,672,539 A 6/1972 Forrer
3,721,335 A 3/1973 Grant
3,754,680 A 8/1973 Wood
3,784,053 A 1/1974 Stout
3,860,113 A 1/1975 Helms
3,917,059 A 11/1975 Wood
3,917,060 A 11/1975 Wood
3,917,061 A 11/1975 Stout
4,000,813 A 1/1977 Stout
4,010,847 A 3/1977 Wood
4,153,158 A 5/1979 Graser
4,171,046 A 10/1979 Bonczyk
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,308,950 A 1/1982 Wood
4,319,682 A 3/1982 Wright
4,362,240 A 12/1982 Elward
4,374,561 A 2/1983 Stout
4,382,505 A 5/1983 Sutherland et al.
4,406,365 A 9/1983 Kulig
4,413,729 A 11/1983 Wood
4,450,956 A 5/1984 Wood
4,469,222 A * 9/1984 Graser ..... B65D 71/38 206/427
4,480,746 A 11/1984 Wood
4,544,092 A 10/1985 Palmer
4,591,090 A 5/1986 Collins
4,722,437 A 2/1988 Walsh
4,770,294 A 9/1988 Graser
4,792,038 A 12/1988 Cooper
4,798,285 A 1/1989 Hernandez
4,901,849 A 2/1990 Wilson
4,927,009 A 5/1990 Stout
5,029,698 A 7/1991 Stout
5,040,672 A 8/1991 Demaio
5,072,876 A 12/1991 Wilson
5,123,588 A 6/1992 Harris
5,191,976 A 3/1993 Stout
5,234,103 A 8/1993 Schuster
5,246,113 A 9/1993 Schuster
5,282,348 A 2/1994 Dampier
5,359,830 A 11/1994 Olson
5,360,104 A 11/1994 Sutherland
5,363,954 A 11/1994 Dampier
5,400,901 A 3/1995 Harrelson
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,579,625 A 12/1996 Olson
5,590,762 A 1/1997 Harrelson
5,593,027 A 1/1997 Sutherland
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,695,051 A 12/1997 Hart
5,765,685 A 6/1998 Roosa
5,775,487 A 7/1998 Harrelson
5,819,920 A 10/1998 Sutherland
5,855,316 A 1/1999 Spivey
5,871,090 A 2/1999 Doucette
5,878,877 A 3/1999 Sutherland
5,884,756 A 3/1999 Holley, Jr.
5,947,273 A 9/1999 Dalrymple
6,041,920 A 3/2000 Hart
6,112,977 A 9/2000 Sutherland
6,131,729 A 10/2000 Eckermann
6,155,962 A 12/2000 Dalrymple
6,168,013 B1 1/2001 Gomes
6,230,881 B1 5/2001 Collura
6,247,585 B1 6/2001 Holley, Jr.
6,315,111 B1 11/2001 Sutherland
6,341,689 B1 1/2002 Jones
6,371,287 B1 4/2002 Jones
6,695,137 B2 2/2004 Jones
6,736,260 B2 5/2004 Gomes
6,802,802 B2 10/2004 Woog
6,814,228 B2 11/2004 Sutherland
6,938,756 B2 9/2005 Schuster
7,011,209 B2 3/2006 Sutherland
7,025,197 B2 4/2006 Sutherland
7,070,045 B2 7/2006 Theelen
7,128,206 B2 10/2006 Kohler
7,134,547 B2 11/2006 Auclair
7,207,934 B2 4/2007 Schuster
7,374,038 B2 5/2008 Smalley
7,448,492 B2 11/2008 Sutherland
7,472,791 B2 1/2009 Spivey, Sr.
7,552,820 B2 6/2009 Kohler
7,604,116 B2 10/2009 Schuster
7,644,817 B2 1/2010 Sutherland
7,677,387 B2 3/2010 Brand
7,762,395 B2 7/2010 Sutherland
7,762,397 B2 7/2010 Coltri-Johnson
7,793,780 B2 9/2010 Smalley
8,490,785 B2 7/2013 Brand
11,117,704 B2 9/2021 Chen
11,472,596 B2 10/2022 Chen
11,505,364 B2 11/2022 Chen
D972,942 S 12/2022 Holley, Jr.
11,548,708 B2 1/2023 Holley, Jr.
D997,739 S 9/2023 Chen
D997,740 S 9/2023 Chen
D997,741 S 9/2023 Chen
D1,007,300 S 12/2023 Chen
D1,026,667 S 5/2024 Chen
D1,096,442 S 10/2025 Chen
2002/0077236 A1 6/2002 Chalendar
2002/0117407 A1 8/2002 Holley
2003/0159950 A1 8/2003 Jones
2004/0050722 A1 3/2004 Schuster
2004/0094435 A1 5/2004 Auclair
2005/0211577 A1 9/2005 Bakx
2005/0218014 A1 10/2005 Schuster
2005/0230273 A1 10/2005 Kohler
2006/0148629 A1 7/2006 Cuomo
2006/0157545 A1 7/2006 Auclair
2007/0151873 A1 7/2007 Schuster
2008/0210581 A1 9/2008 Brand
2010/0006458 A1 1/2010 Wilkins
2010/0147932 A1* 6/2010 Brand ..... B65D 71/0055 493/128
2015/0191284 A1* 7/2015 Sutherland ..... B65D 71/20 229/117.14
2015/0266640 A1 9/2015 Thompson

(56) References Cited

U.S. PATENT DOCUMENTS

FOREIGN PATENT DOCUMENTS

| | | |
|---|---|---|
| WO | 9306825 | 4/1993 |
| WO | 9509780 | 4/1995 |
| WO | 9705026 | 2/1997 |

* cited by examiner

CARTON FOR CONTAINERS

CROSS-REFERENCE TO RELATED APPLICATION

The present application claims the benefit of U.S. Provisional Patent Application No. 63/466,048, filed on May 12, 2023.

INCORPORATION BY REFERENCE

The disclosure of U.S. Provisional Patent Application No. 63/466,048, filed on May 12, 2023, is hereby incorporated by reference herein as if set forth in its entirety.

BACKGROUND OF THE DISCLOSURE

The present disclosure generally relates to cartons for holding beverage containers or other types of articles. More specifically, the present disclosure relates to cartons with divider features.

SUMMARY OF THE DISCLOSURE

According to one aspect, the disclosure is generally directed to a carton for holding a plurality of containers, the carton comprising a plurality of panels at least partially extending around an interior of the carton, the plurality of panels comprising a front panel, a back panel, at least one side panel, at least one top panel, and at least one bottom panel, and a divider extending through the interior of the carton to form a front interior space and a back interior space, the divider including a divider panel attached to the at least one side panel.

According to another aspect, the disclosure is generally directed to a combination of blanks for forming a carton for holding a plurality of containers, the combination comprising a carton blank comprising a plurality of panels for at least partially extending around an interior of the carton formed from the combination of blanks, the plurality of panels comprising a front panel, a back panel, at least one side panel, at least one top panel, and at least one bottom panel, and a divider blank comprising a divider panel for being attached to the at least one side panel of the carton blank when the carton is formed from the combination of blanks to extend through the interior of the carton and form a front interior space and a back interior space in the carton formed from the combination of blanks.

According to another aspect, the disclosure is generally directed to a method of forming a carton for holding a plurality of containers, the method comprising obtaining a carton blank comprising a plurality of panels the plurality of panels comprising a front panel, a back panel, at least one side panel, at least one top panel, and at least one bottom panel, obtaining a divider blank comprising a divider panel, positioning the plurality of panels of the carton blank extending at least partially around an interior of the carton, and attaching the divider panel to the at least one side panel to form a divider extending through the interior of the carton and forming a front interior space and a back interior space in the interior of the carton.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to cartons that contain articles, for example, containers such as bottles, cans, etc. The articles can be used, for example, for packaging food and beverage products. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum cans or glass beverage bottles) as disposed within the carton embodiments. In this specification, the terms "inner," "outer," "lower," "bottom," "upper," and "top" indicate orientations determined in relation to fully erected and upright cartons.

As described herein, cartons may be formed by multiple overlapping panels and/or end flaps. Such panels and/or end flaps may be designated in relative terms to one another, e.g., "first", "second", "third", etc., in sequential or non-sequential reference, without departing from the disclosure.

Figure 1:
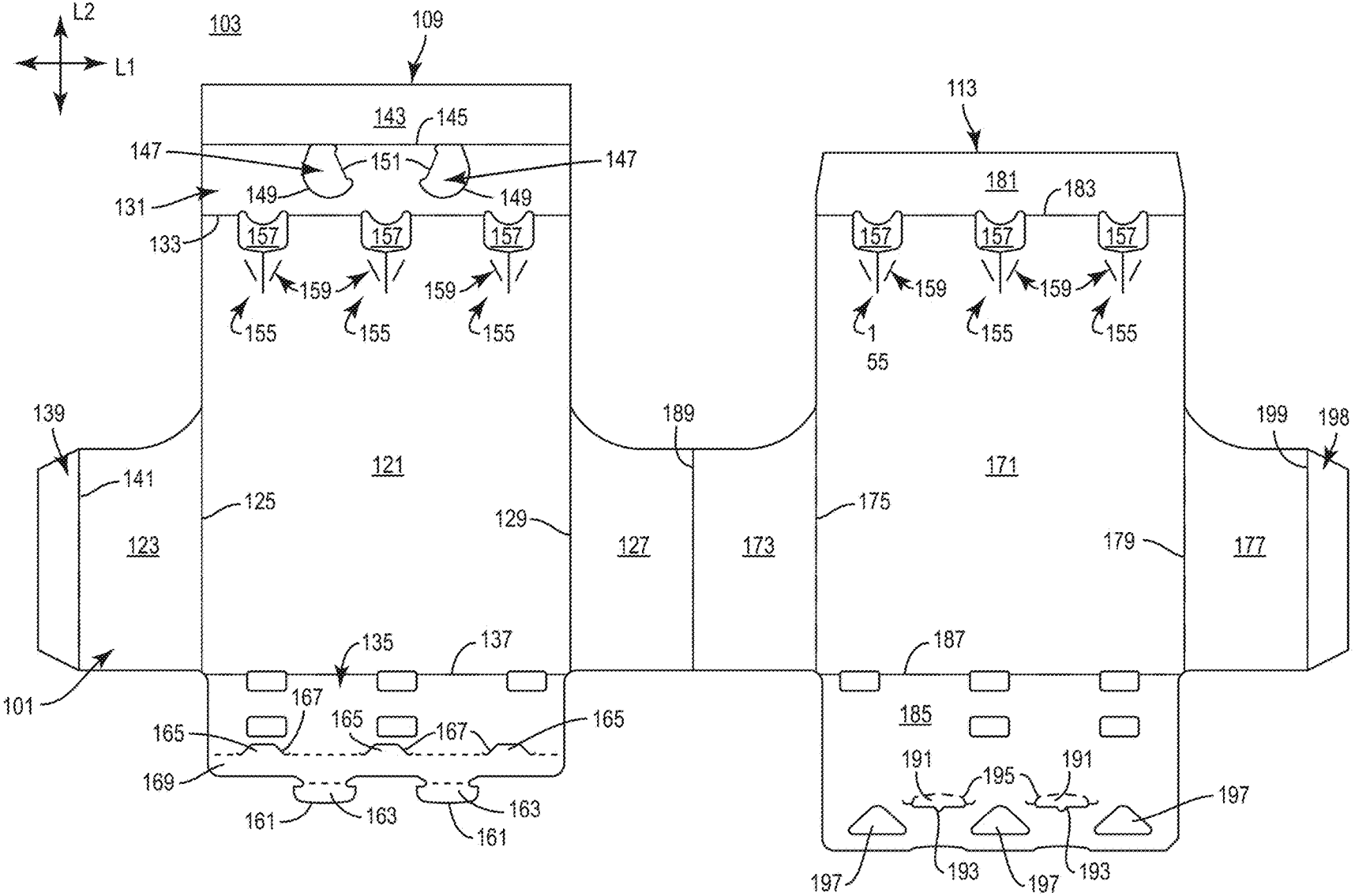
FIG. 1 is a plan view of an exterior surface of a carton blank for forming a carton according to an exemplary embodiment of the disclosure.

FIG. 1 shows a plan view of the exterior surface 101 of a first blank or carton blank, generally indicated at 103, that can be obtained to form a carton 105 (FIG. 3) according to an exemplary embodiment of the disclosure.

Figure 6:
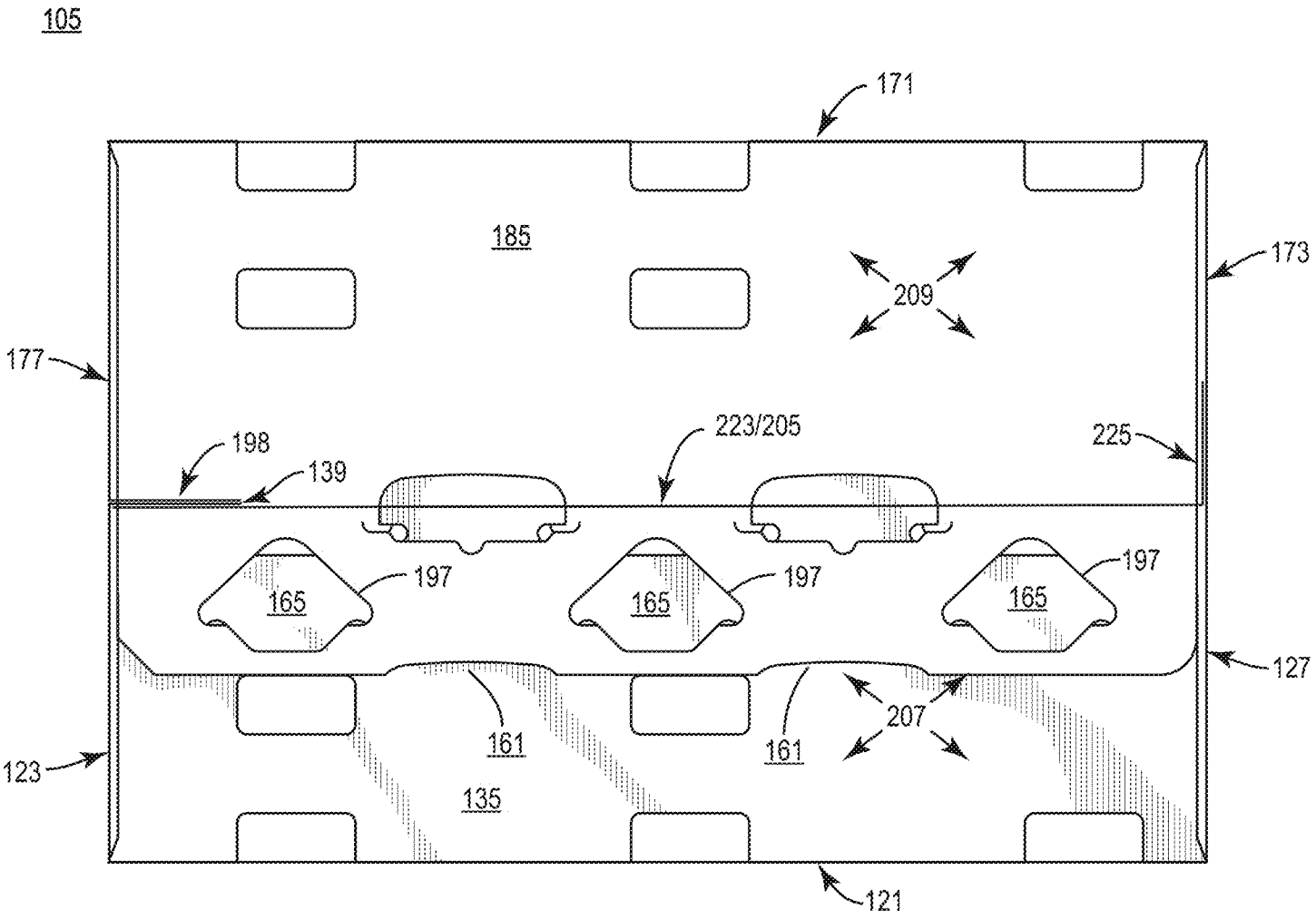
FIG. 6 is a cross-sectional view taken along the line 6-6 of FIG. 4.

As described herein, the carton 105 can be used to house a plurality of articles in an interior 107 thereof such as containers in the form of beverage containers C (FIG. 6). The containers C can be beverage bottles, e.g., bottles formed of glass or metal, and having upper portions that include an at least partially tapered neck portion intersecting a flange that at least partially supports a cap. In other embodiments, the containers could be beverage cans or another suitable type and size of container.

The carrier 105 is sized to contain or support six containers C in two rows of three containers, but it will be understood that the carrier 105 can be sized and shaped to hold containers of a different or same quantity in more than one layer and/or in different row/column arrangements (e.g., 1×6, 2×2, 2×3, 2×4, 2×5, 2×6, 3×3, 3×4, 2×5, 3×6, 2×6×2, 3×5, 3×4, 4×5, 2×9, 2×6, 4×4, 4×5, 4×6, etc.).

Figure 2:
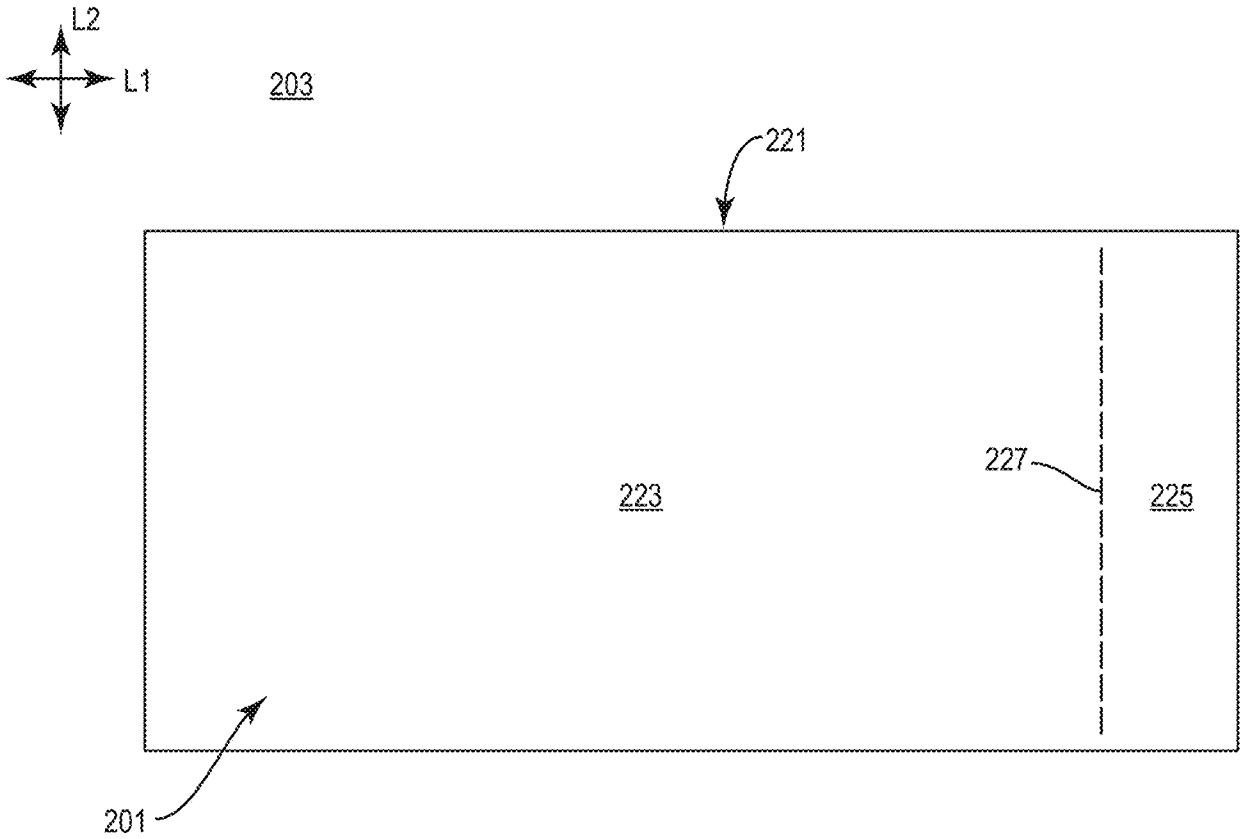
FIG. 2 is a plan view of an exterior surface of a divider blank for forming a divider according to an exemplary embodiment of the disclosure.

As also described herein, the carton 105 can be provided together with a divider 205 (FIG. 3) formed from a divider blank 203 (FIG. 2). In some embodiments, the carton 105 can be considered to include both the construct formed from the blank 103 as well as the divider 205 formed from the divider blank 203. As shown in FIG. 6, the carton 105 can be provided with at least one container C as a package 110.

With continued reference to FIG. 1, the blank 103 can have a longitudinal axis L1 and a lateral axis L2, and a plurality of panels for at least partially extending around an interior 107 of the carton 105 formed from the blank 103.

As shown, the blank 103 and carton 105 formed therefrom can have a front portion 109 for forming a front portion 111 of the carton 105, and a back portion 113 for forming a back portion 115 of the carton 105. The front portion 109 of the blank 103 and the back portion 113 of the blank 103 can be foldably connected at a fold line 189, as described further herein.

The front portion 109 of the blank 103 can include a front panel 121, a first side panel 123 (broadly, "second side panel", "third side panel", or "fourth side panel") foldably connected to the front panel 121 at a lateral fold line 125, a second side panel 127 (broadly, "first side panel, "third side panel", or "fourth side panel") foldably connected to the front panel 121 at a lateral fold line 129, a first top panel 131 foldably connected to the front panel 121 at a longitudinal fold line 133, and a first bottom panel 135 foldably connected to the front panel 121 at a longitudinal fold line 137.

The front portion 109 of the blank 103 and the front portion 113 of the carton 105 formed therefrom can include a plurality of end flaps foldably connected to a respective panel of the plurality of panels. In the illustrated embodiment, the plurality of end flaps of the front portion 109/113 can include a side attachment flap 139 foldably connected to the side panel 123 at a lateral fold line 141, and a top attachment flap 143 foldably connected to the top panel 131 at a longitudinal fold line 145. In some embodiments, the attachment flap 143 can be considered a top panel or a portion of a top panel.

The blank 103 and carton 105 formed therefrom can also include handle features that include a pair of handle flaps 147 at least partially defined by respective generally curved cuts 149 in the top panel 131 that intersect the fold line 145. The handle flaps 147 can be foldably connected to the top panel 131 at respective oblique fold lines 151 and can be at least partially separable therefrom at the respective cuts 149.

The blank 103 and carton 105 formed therefrom can also include container retention features 155 that include respective container openings 157 for at least partially receiving a portion of a respective container therethrough, and a plurality of fold lines 159 extending away from the respective opening 157 to facilitate at least partial reconfiguration of the front panel 121 proximate the openings 157, for example, to accommodate the size and shape of a container in the carton 105.

The blank 103 and carton formed therefrom can also include closure features or locking features that include a plurality of locking tabs 161 (broadly, "first locking tabs") foldably connected to the bottom panel 135 at respective longitudinal fold lines 163 and extending away therefrom, and a plurality of locking tabs 165 (broadly, "second locking tabs") at least partially defined by cuts 167 in the bottom panel 135 that interrupt a line of weakening 169.

With continued reference to FIG. 1, the back portion 113 of the blank 103 and the back portion 115 of the carton 105 formed therefrom can include a back panel 171, a first side panel 173 (broadly, "second side panel", "third side panel", or "fourth side panel") foldably connected to the back panel 171 at a lateral fold line 175, a second side panel 177 (broadly, "first side panel, "third side panel", or "fourth side panel") foldably connected to the back panel 171 at a lateral fold line 179, a second top panel 181 foldably connected to the back panel 171 at a longitudinal fold line 183, and a second bottom panel 185 foldably connected to the back panel 171 at a longitudinal fold line 187. As shown, the side panel 173 can be foldably connected to the side panel 127 at a lateral fold line 189 such that the front portion 109/111 of the blank 103/carton 105 is foldably connected to the back portion 113/115 of the blank 103/carton 105.

As shown, the bottom panel 185 can include locking flaps 191 at least partially separable from the bottom panel 185 at respective cuts 193 and foldably connected thereto at respective generally curved fold lines 195. A plurality of locking openings 197 can also be defined in the bottom panel 185.

In some embodiments, an attachment flap 198 can also be foldably connected to the side panel 177 at a lateral fold line 199.

As further shown, container retention features 155 can be at least partially formed along the back panel 171 and can generally correspond to the arrangement of the container retention features 155 at least partially formed along the front panel 155, though a different arrangement of container retention features could be provided without departing from the disclosure.

Turning to FIG. 2, an exterior surface 201 of the divider blank 203 is illustrated according to an exemplary embodiment of the disclosure. As shown, the divider blank 203 can have the longitudinal axis L1, the lateral axis L2, and can include a divider panel 221 that includes a divider portion 223 and an attachment portion 225 at least partially foldably connected to the divider portion 223 at a lateral fold line 227. While the divider blank 203/divider panel 221 is shown having a generally rectangular profile, it will be understood that the divider blank 203/divider panel 221 can be otherwise shaped, sized, and/or configured without departing from the disclosure.

In some embodiments, the divider portion 223 can be considered an end flap foldably connected to the divider panel 221/divider portion 223 at the fold line 227.

With additional reference to FIGS. 3 and 4, formation of the carton 105 from the blanks 103, 203 will be described according to an exemplary embodiment of the disclosure.

In some embodiments, the carton blank 103 can be inverted such that the exterior surface 101 thereof is positioned in at least partial face-to-face contact with a supporting surface, and such that an interior surface thereof is facing upwardly.

The divider blank 203 can be positioned on the blank 103 such that the attachment portion 225 of the divider panel 221 is in at least partial face-to-face contact with the side panel 173 and with the divider portion 223 thereof positioned extending across respective portions of the side panel 127 and the front panel 121.

The side panel 123 can then be folded at the fold line 125 into at least partial face-to-face contact with a respective portion of the front panel 121 and such that the attachment flap 139 is carried into at least partial face-to-face contact with a laterally outer marginal portion of the divider portion 223 of the divider panel 221.

Simultaneously or thereafter, the side panel 177 can be folded at the fold line 179 into at least partial face-to-face contact with the back panel 171 and such that the attachment flap 198 is carried into at least partial face-to-face contact with the back panel 171.

The side panel 173 can then be folded at the fold line 189 into at least partial face-to-face contact with respective portions of the divider panel 221 and side panel 127, and such that the back panel 171 (and the side panel 177 and attachment flap 198 overlapped thereupon) is carried into at least partial face-to-face contact with respective portions of the divider panel 221, the side panel 123, and the attachment flap 139.

In some embodiments, the attachment portion 225 of the divider panel 221 can be positioned in at least partial face-to-face contact with the side panel 127 and the divider portion 223 thereof can be positioned extending across respective portions of the side panel 173 and the back panel 171. The side panel 177 can then be folded at the fold line 179 into at least partial face-to-face contact with a respective portion of the back panel 171 such that the attachment flap 198 is carried into at least partial face-to-face contact with a laterally outer marginal portion of the divider portion 223 of the divider panel 221. Thereafter, the side panel 123 could be folded at the fold line 125 such that the side panel 123 and the attachment flap 139 carried therewith are positioned in at least partial face-to-face contact with respective portions of the front panel 121.

The side panel 127 could then be folded at the fold line 189 into at least partial face-to-face contact with respective portions of the divider panel 221 and side panel 173, and such that the front panel 121 (and the side panel 123 and attachment flap 139 overlapped thereupon) is carried into at least partial face-to-face contact with respective portions of the divider panel 221, the side panel 123, and the attachment flap 139.

In the aforementioned arrangements, the fold line 227 of the divider blank 203 can be positioned in general alignment with the fold line 189 of the carton blank 103, with the attachment portion 225 of the divider panel 221 in at least partial face-to-face contact with one of the side panels 127, 173, and with a marginal edge portion of the divider portion 223 of the divider panel 221 in at least partial face-to-face contact with one of the attachment flaps 139, 198. The attachment flaps 139, 198 can be positioned in at least partial face-to-face contact with one another.

It will be understood that the attachment portion 225 of the divider panel 221 can be adhered to one of the side panels 127, 173 and that the marginal edge portion of the divider portion 223 of the divider panel 221 can be adhered to one of the attachment flaps 139, 198 with an adhesive such as glue. In some embodiments, glue can be applied to the interior surface of the attachment flap 139, the interior surface of the side panel 173, and the exterior surface of the divider flap 198. In some embodiments, glue can be applied to the interior surface of the attachment flap 198, the interior surface of the side panel 127, and the exterior surface of the divider flap 139.

The aforementioned arrangement can also position the top panel 181 in at least partial face-to-face contact with the top panel 131. The attachment flap 143 can also be folded at the fold line 145 into at least partial face-to-face contact with a portion of the exterior surface of the top panel 181, with the top panel 131 extending away therefrom. In some embodiments, glue can be applied to the interior surface of the attachment flap 143 to maintain such arrangement of the panels 131, 181.

Such a folded configuration of the blanks 103, 203/carton 105 can be a collapsed configuration of the carton 105 with a minimized profile, for example, for shipping, storage, etc.

Further erection of the carton 105 can include positioning the front panel 121 and the back panel 171 in generally parallel and spaced relation, with the side panels 127, 173 in generally coplanar relation extending from the front panel 121 to the back panel 171, and with the side panels 123, 177 in generally coplanar relation and extending from the front panel 121 to the back panel 171.

The top panels 131, 181 can be positioned in generally coplanar relation extending from an upper edge of the front panel 121 to an upper edge of the back panel 171, with the attachment flap 143 overlapping the top panel 181. In some embodiments, upper portions of one or both of the front panel 121 and the back panel 171 can be bent toward the top panels 131, 181.

Furthermore, the bottom panels 135, 185 can be at least partially overlapped to form a closed bottom of the carton 105. In some embodiments, the locking flaps 191 can be at least partially separated from the bottom panel at the respective cuts 193 and folded at least partially away therefrom at the fold lines 195 to provide locking openings for at least partially receiving the locking tabs 161 therethrough. The locking tabs 161 may be at least partially folded at the respective fold line 163 to effect such engagement.

The locking tabs 165 can also be at least partially separated from the bottom panel 135 at the cuts 167 for extending away therefrom and for being at least partially received in the locking openings 197, e.g., so as to lie in an at least partially overlapping and/or face-to-face engagement with an interior surface of a marginal portion of the bottom panel 185.

It will be understood that one or more containers can be loaded into the interior 107 of the carton 105 prior to or following the complete formation thereof. Upon such loading of containers, a portion of a respective container can be at least partially received through the openings 157 of the respective container retention features 155, which can cause at least partial reconfiguration of a respective panel 121, 171 facilitated by the fold lines 159.

Figure 3:
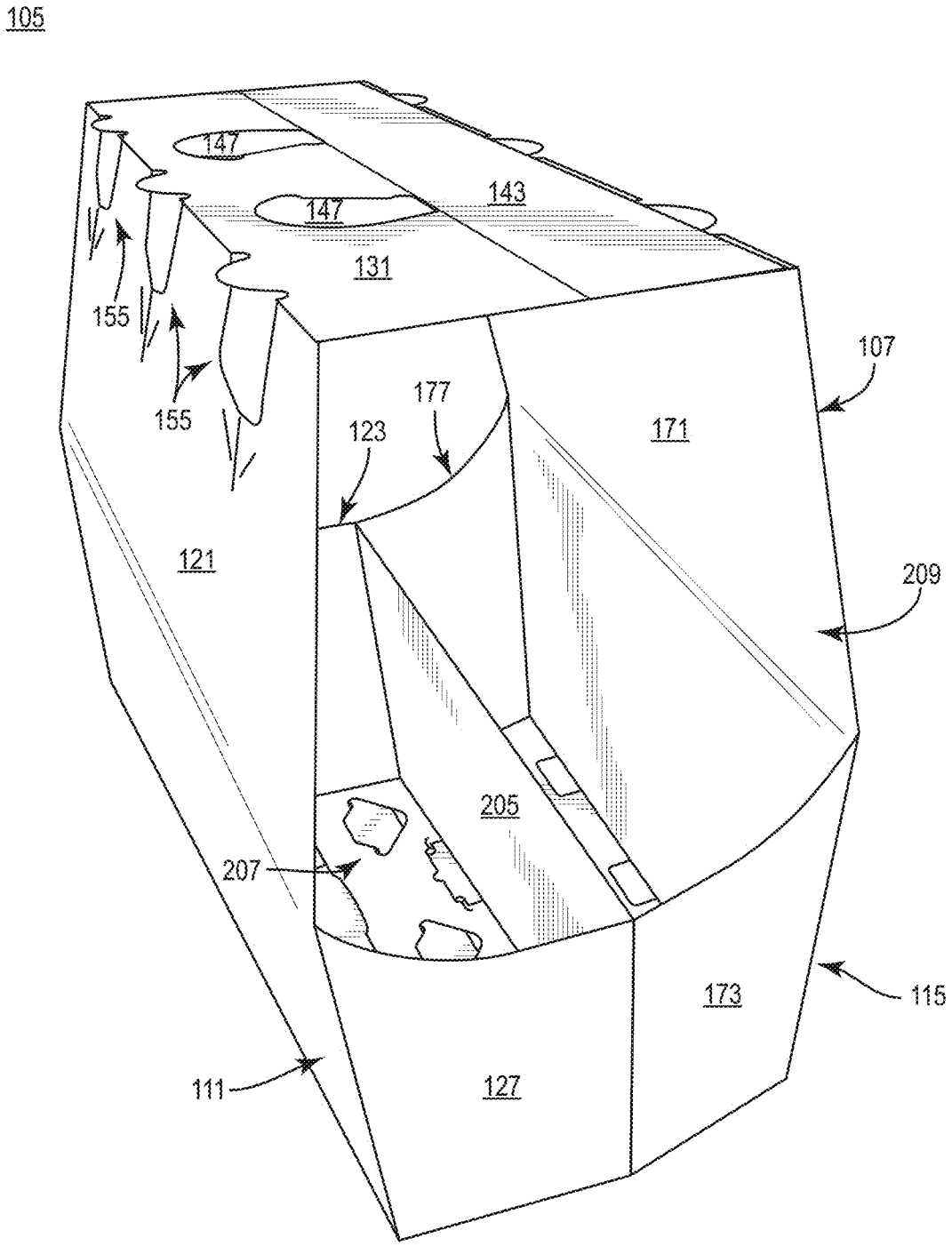
FIGS. 3 and 4 are perspective views of a carton formed from the blanks of FIGS. 1 and 2 according to an exemplary embodiment of the disclosure.
Figure 4:
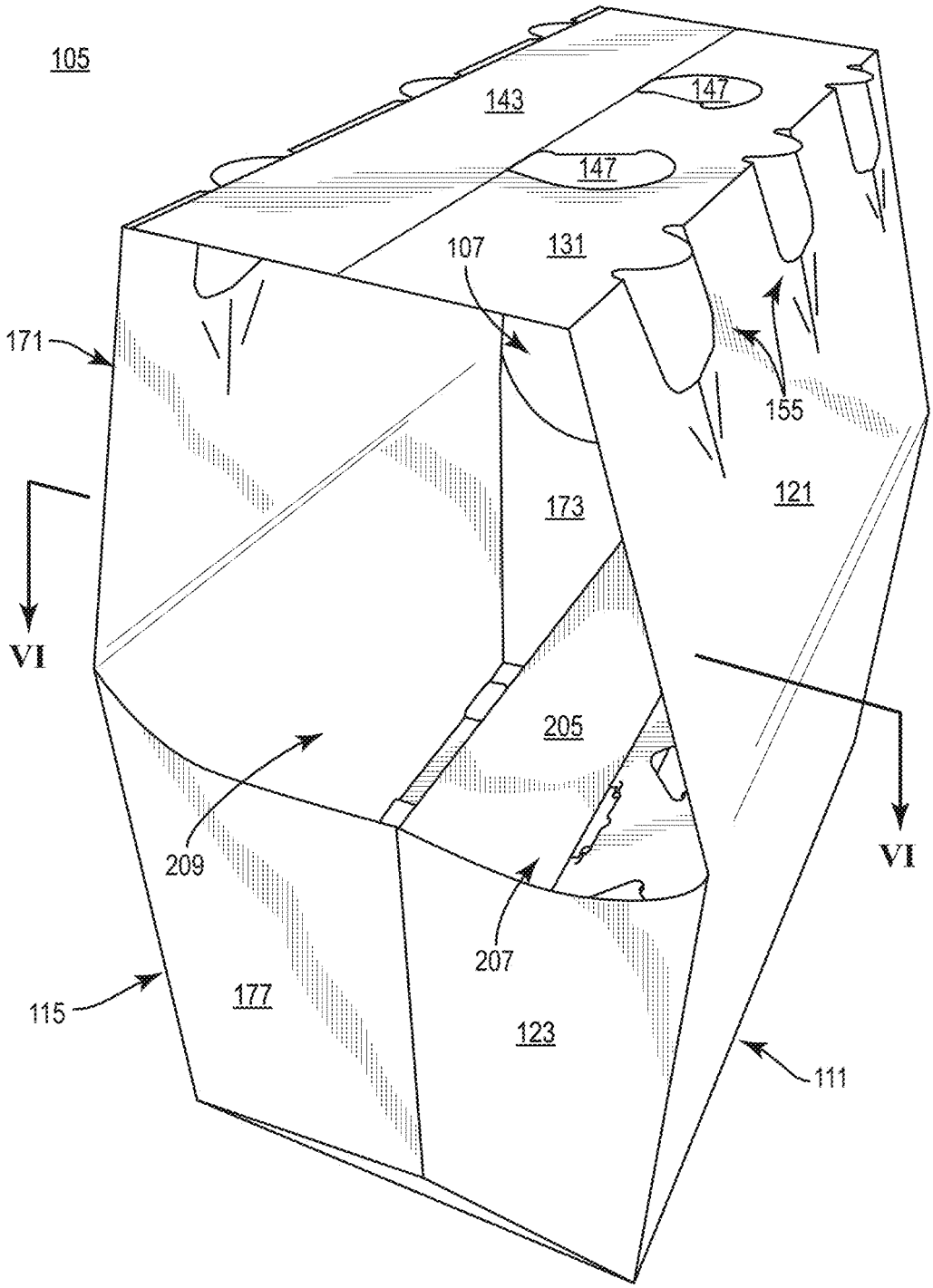
Figure 5:
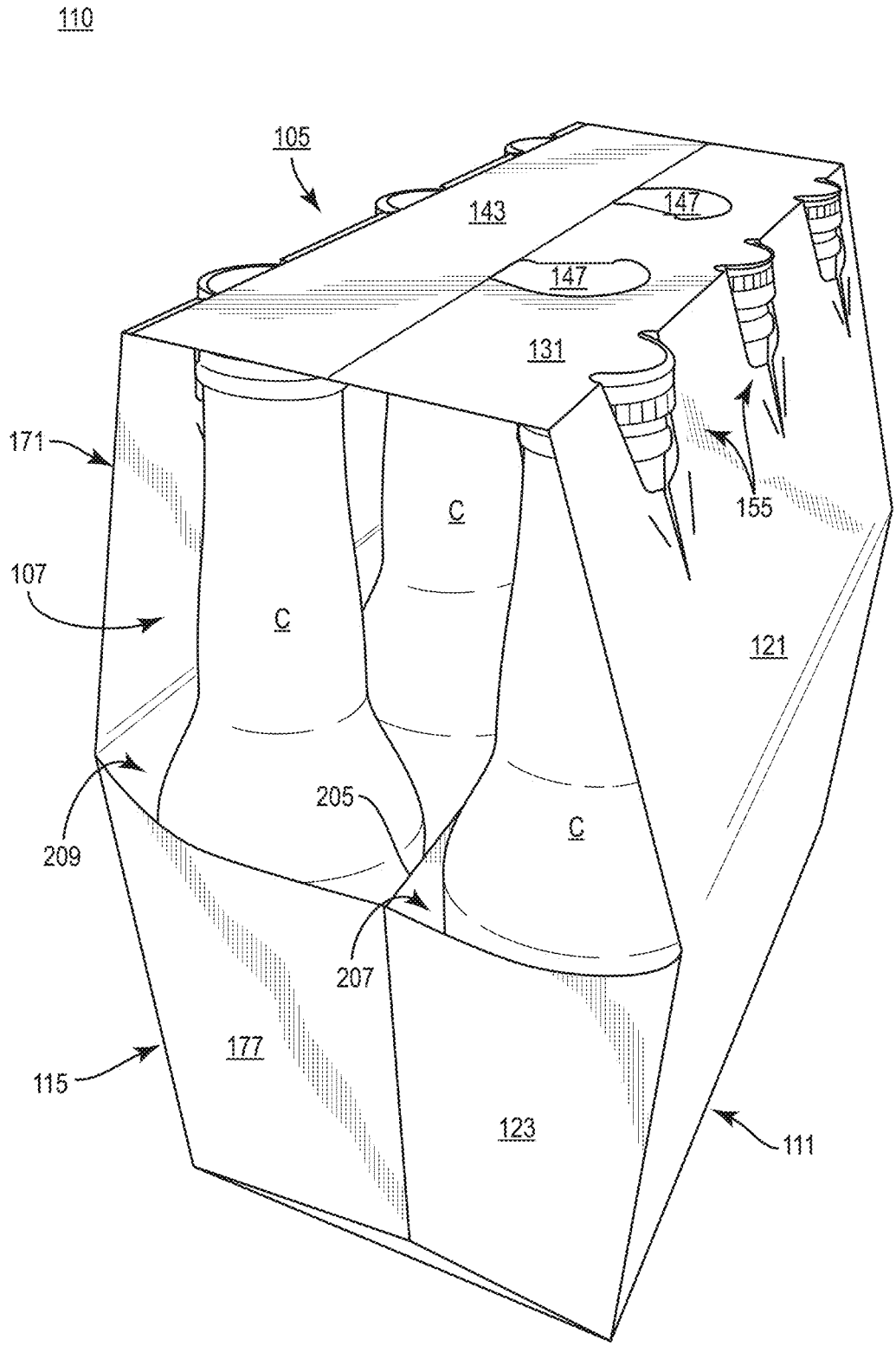
FIG. 5 is a perspective view of a package including the carton of FIG. 4 and at least one container.

In the erected configuration of the carton 105 shown in FIGS. 3 and 4, the divider panel 221 is positioned at least partially attached to the side panel 173 via the attachment portion 225 thereof, and extending through the interior 107 of the carton 105 to the attachment flap 139 at which the divider portion 223 is attached.

In this regard, the divider panel 221 is arranged so as to form a divider 205 in the interior 107 of the carton 105 the at least partially partitions the interior 107 of the carton 107 into a front interior space 207 and a back interior space 209. The divider portion 225 of the divider panel 221 can be positioned extending in generally parallel relation with the front panel 121 and the back panel 171.

Furthermore, the divider portion 225 of the divider panel 221 can be positioned extending upwardly, e.g., in generally perpendicular relation to, the bottom panels 135, 185. In some embodiments, the divider portion 225 of the divider panel 221 can be positioned extending upwardly from an overlapping portion of the bottom panels 135, 185 at least partially vertically into the interior 107 of the carton 105. In this regard, the divider portion 225 of the divider panel 221 can be positioned extending generally parallel to the front panel 121 and the back panel 171, generally perpendicular to the bottom panels 135, 185, and generally perpendicular to each of the side panels 123, 127, 173, 177.

In some embodiments, the front interior space 207 of the carton 105 can be at least partially defined between respective portions of the side panel 123, the side panel 127, the front panel 121, and the bottom panel 185. The back interior space 209 of the carton 105 can be at least partially defined between respective portions of the side panel 173, the side panel 177, the back panel 171, and the bottom panel 185.

When it is desired to lift or move the carton 105, a user can press one or more of his or her fingers against a respective handle flap 147 to cause at least partial separation thereof from the top panel 131 at the respective cuts 149 and at least partial folding away therefrom at the respective fold line 151 to at least partially expose a handle opening. The user can then insert one or more of his or her fingers into the respective handle opening to engage an underside of one or both of the top panels 131, 181, to provide a surface against which the carton 105 can be lifted or otherwise moved.

In view of the foregoing, the carton 105 is formed from separate blanks 103, 203 so as to form the carton 105 with an interior partition via the divider panel 221. Such partition can provide, for example, convenient separation of containers for loading, display, dispensing purposes, etc., to provide a buffer between containers in the front portion 111 of the carton 105 and the back portion 115 of the carton 105, etc.

The provision of the carton 105 having the divider 205 formed from separate blanks 103, 203, respectively is such that the divider 205 can be free from foldable connection to the remainder of the carton 105, e.g., such that neither the attachment portion 225 nor the divider portion 223 are foldably connected to any other portion of the carton 105. In this regard, manufacturing processes can be streamlined, e.g., by preparing the carton blank 103 and divider blank 203 separately. In some embodiments, the divider blank 203 and divider 205 formed therefrom can comprise waste paperboard material, e.g., excess paperboard material associated with the carton blank 103 or with an entirely different paperboard product so as to use material that might otherwise be discarded.

Any of the features of the various embodiments of the disclosure can be combined with, replaced by, or otherwise configured with other features of other embodiments of the disclosure without departing from the scope of this disclosure. Further, it is noted that the nesting arrangements and/or the features of the blanks and cartons of the various embodiments can be incorporated into a carton or blank having any carton style or panel configuration. The carton styles and panel configurations described above are included by way of example.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels at least partially extending around an interior of the carton, the plurality of panels comprising a front panel, a back panel, a first side panel, a second side panel, at least one top panel, and at least one bottom panel; and a divider extending through the interior of the carton to form a front interior space and a back interior space, the divider including a divider panel attached to the first side panel and the second side panel, the divider panel comprises a divider portion and an attachment portion foldably connected to the divider portion, the attachment portion of the divider panel in at least partial face-to-face contact with the first side panel, an attachment flap foldably connected to the second side panel, the attachment flap is attached to the divider portion of the divider panel, the attachment portion of the divider panel is adhered to the first side panel with glue and the attachment flap is adhered to the divider portion with glue.

2. The carton of claim 1, wherein the divider panel is free from foldable attachment to the remainder of the carton.

3. The carton of claim 2, wherein the divider portion is generally parallel to each of the front panel and the back panel.

4. The carton of claim 3, wherein the divider portion is generally perpendicular to the at least one bottom panel.

5. The carton of claim 4, wherein the first side panel is foldably connected to one of the front panel and the back panel, and the second side panel is foldably connected to the other of the front panel and the back panel.

6. The carton of claim 5, wherein the plurality of panels further comprises a third side panel foldably connected to the one of the front panel and the back panel, and a fourth side panel foldably connected to the other of the front panel and the back panel.

7. The carton of claim 6, wherein the attachment flap is a first attachment flap foldably connected to the second side panel, and the carton further comprises a second attachment flap foldably connected to the third side panel, the first attachment flap is in at least partial face-to-face contact with the second attachment flap.

8. The carton of claim 7, further comprising container retention features comprising a plurality of container openings in each of the front panel and the back panel for at least partially receiving a respective container of the plurality of containers and a plurality of fold lines extending away from a respective container opening of the plurality of container openings.

9. The carton of claim 8, wherein the plurality of panels further comprises a front bottom panel foldably connected to the front panel and a back bottom panel foldably connected to the back panel, the front bottom panel at least partially overlapped with the back bottom panel.

10. The carton of claim 9, wherein the front bottom panel comprises at least one locking tab at least partially received in at least one locking opening at least partially defined in the back bottom panel.

11. The carton of claim 10, wherein the carton comprises handle features, the handle features comprise at least one handle flap foldably connected to and at least partially separable from the at least one top panel.

12. A combination of blanks for forming a carton for holding a plurality of containers, the combination comprising:

a carton blank comprising a plurality of panels for at least partially extending around an interior of the carton formed from the combination of blanks, the plurality of panels comprising a front panel, a back panel, a first side panel, a second side panel, at least one top panel, and at least one bottom panel; and a divider blank for forming a divider panel and comprising a divider portion and an attachment portion foldably connected to the divider portion, the divider blank attached to the first side panel and the second side panel of the carton blank when the carton is formed from the combination of blanks to extend through the interior of the carton and form a front interior space and a back interior space in the carton formed from the combination of blanks, the attachment portion of the divider blank in at least partial face-to-face contact with the first side panel in the carton formed from the combination of blanks, the carton blank comprises an attachment flap foldably connected to the second side panel, the attachment flap is attached to the divider portion of the divider blank in the carton formed from the combination of blanks, the attachment portion of the divider blank is adhered to the first side panel with glue and the attachment flap is adhered to the divider portion with glue in the carton formed from the combination of blanks.

13. The combination of claim 12, wherein the divider blank is free from foldable attachment to the carton blank.

14. The combination of claim 12, wherein the first side panel is foldably connected to one of the front panel and the back panel, and the second side panel is foldably connected to the other of the front panel and the back panel.

15. The combination of claim 14, wherein the plurality of panels further comprises a third side panel foldably connected to the one of the front panel and the back panel, and a fourth side panel foldably connected to the other of the front panel and the back panel.

16. The combination of claim 15, wherein the attachment flap is a first attachment flap foldably connected to the second side panel, and the carton blank further comprises a second attachment flap foldably connected to the third side panel, the first attachment flap is for being positioned in at least partial face-to-face contact with the second attachment flap when the carton is formed from the combination of blanks.

17. The combination of claim 16, further comprising container retention features comprising a plurality of container openings in each of the front panel and the back panel for at least partially receiving a respective container of the plurality of containers when the carton is formed from the combination of blanks, and a plurality of fold lines extending away from a respective container opening of the plurality of container openings.

18. The combination of claim 17, wherein the plurality of panels further comprises a front bottom panel foldably connected to the front panel and a back bottom panel foldably connected to the back panel, the front bottom panel for being at least partially overlapped with the back bottom panel when the carton is formed from the combination of blanks.

19. The combination of claim 18, wherein the front bottom panel comprises at least one locking tab for being at least partially received in at least one locking opening at least partially defined in the back bottom panel when the carton is formed from the combination of blanks.

20. The combination of claim 19, wherein the carton comprises handle features, the handle features comprise at least one handle flap foldably connected to and at least partially separable from the at least one top panel.

21. A method of forming a carton for holding a plurality of containers, the method comprising:

obtaining a carton blank comprising a plurality of panels the plurality of panels comprising a front panel, a back panel, a first side panel, a second side panel, at least one top panel, and at least one bottom panel;

obtaining a divider blank comprising a divider portion and an attachment portion foldably connected to the divider portion;

positioning the plurality of panels of the carton blank extending at least partially around an interior of the carton; and attaching the divider blank to the first side panel and to the second side panel to form a divider extending through the interior of the carton and forming a front interior space and a back interior space in the interior of the carton, positioning the attachment portion of the divider blank in at least partial face-to-face contact with the first side panel, the carton blank comprises an attachment flap foldably connected to the second side panel, and the method comprises adhering the attachment portion of the divider blank to the first side panel with glue and adhering the attachment flap to the divider portion with glue.

22. The method of claim 21, wherein the divider blank is free from foldable attachment to the remainder of the carton.

23. The method of claim 22, wherein the method comprises positioning the divider portion generally parallel to each of the front panel and the back panel.

24. The method of claim 23, wherein the method comprises positioning the divider portion generally perpendicular to the at least one bottom panel.

25. The method of claim 21, wherein the first side panel is foldably connected to one of the front panel and the back panel, and the second side panel is foldably connected to the other of the front panel and the back panel.

26. The method of claim 25, wherein the plurality of panels further comprises a third side panel foldably connected to the one of the front panel and the back panel, and a fourth side panel foldably connected to the other of the front panel and the back panel.

27. The method of claim 26, wherein the attachment flap is a first attachment flap foldably connected to the second side panel, and the carton blank further comprises a second attachment flap foldably connected to the third side panel, and the method comprises positioning the first attachment flap in at least partial face-to-face contact with the second attachment flap.

28. The method of claim 27, wherein the carton blank further comprises container retention features comprising a plurality of container openings in each of the front panel and the back panel for at least partially receiving a respective container of the plurality of containers and a plurality of fold lines extending away from a respective container opening of the plurality of container openings.

29. The method of claim 28, wherein the plurality of panels further comprises a front bottom panel foldably connected to the front panel and a back bottom panel foldably connected to the back panel, and the method further comprises at least partially overlapping the front bottom panel with the back bottom panel.

30. The method of claim 29, wherein the front bottom panel comprises at least one locking tab and at least one locking opening is at least partially defined in the back bottom panel, and the method comprises positioning the at least one locking tab at least partially received in the at least one locking opening.

31. The method of claim 30, wherein the carton comprises handle features, the handle features comprise at least one handle flap foldably connected to and at least partially separable from the at least one top panel.

* * * * *